United States Patent [19]

Koeleman et al.

[11] 4,095,886

[45] Jun. 20, 1978

[54] PROCESS AND APPARATUS FOR FIXING IMAGES

[75] Inventors: Gerardus A. J. Koeleman, Velden; Franciscus A. A. E. van de Laarschot, Geldrop, both of Netherlands

[73] Assignee: Océ-van der Grinten N.V., Venlo, Netherlands

[21] Appl. No.: 778,067

[22] Filed: Mar. 16, 1977

[30] Foreign Application Priority Data

Mar. 18, 1976 Netherlands ..... 7602822

[51] Int. Cl.[2] ..... G03G 15/00

[52] U.S. Cl. ..... 355/3 FU; 96/1.4; 219/216; 355/3 TR

[58] Field of Search ..... 355/3 FU, 3 TR, 16; 219/216, 388 W; 96/1.4

[56] References Cited

U.S. PATENT DOCUMENTS

| | | | |
|---|---|---|---|
| 3,893,761 | 7/1975 | Buchan et al. | 355/3 TR |
| 3,923,392 | 12/1975 | Buchan et al. | 355/3 TR |
| 3,955,530 | 5/1976 | Knechtel | 355/3 TR |

*Primary Examiner*—Richard L. Moses

*Attorney, Agent, or Firm*—Albert C. Johnston; Gerard F. Dunne

[57] ABSTRACT

In a process and apparatus for fixing thermoplastic image material onto paper, wherein the image material in thermally softened condition is transported through a pressure zone while being pressed between and in contact with the paper and belt moving together through said zone, and upon leaving said zone the paper and belt are separated from each other by forced movement of the belt along a path curved away from the paper, the fixing of the image material to the paper is achieved reliably in a simple manner, with little sensitivity to variations of temperature or of the character of the belt surface, by maintaining the thickness of the belt, the speed of movement of the belt and the radius of curvature of said path in a relationship defined by the formula: $(D \times V/R) \geqq 0.05$, in which D represents said thickness (in meters), V represents said speed (in meters per second), and R represents said radius (in meters). The process serves effectively for papers of various kinds and thicknesses without need for adjustment of other operating conditions, when the heat softening of the image material is provided by keeping the belt heated to a suitable temperature range between 120° and 170° C. and limiting the time of contact of the paper with the belt to not more than 0.1 second.

14 Claims, 2 Drawing Figures

PROCESS AND APPARATUS FOR FIXING IMAGES

Figure 1:
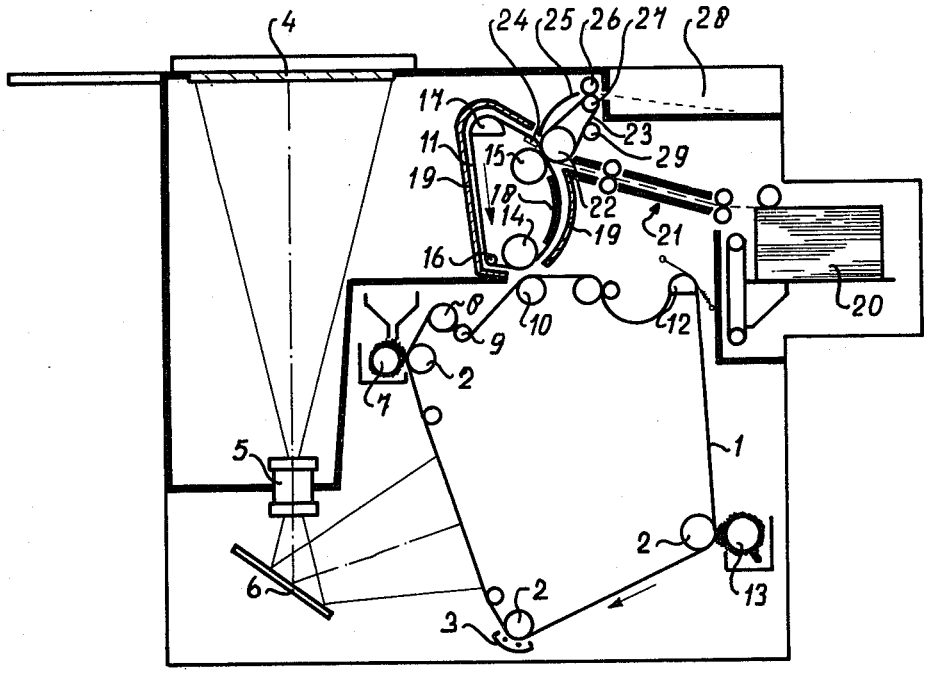

This invention relates to a process and apparatus for fixing onto a substate such as paper, images formed essentially of thermoplastic material, wherein the image material in thermally softened condition is transported through a pressure zone while being pressed between and in contact with the paper and a belt moving together through said zone, and upon leaving the pressure zone the paper and belt are separated from each other, with the image material fixed to the paper, by forced movement of the belt along a path curved away from the paper.

Processes of this kind are known and described in German Offenlegungsschriften Nos. 2,049,293 and 2,460,696 in connection with the manufacture of electrophotographic copies.

With these known processes the image material, which usually contains thermoplastic synthetic resin, is softened by heating before or during the passage through the pressure zone. The viscosity of the image material is thus affected so that under the pressure applied by the belt in the pressure zone the image material forms an imagewise cohesive layer which penetrates at least partially into the paper surface. Thus, upon cooling, the image is attached in a durable and firm manner to the paper, and is fixed thereto.

In order that damage to the image or contamination of the pressure belt may be avoided in the use of these known processes, the image must adhere completely to the paper upon separation of the belt and paper from each other. For that purpose, it is necessary that the adhesion between paper and image material be greater than the adhesion between belt and image material, and moreover the cohesion of the image material must be great enough to prevent splitting of the image during the separation of belt and paper.

This condition can be obtained by making the belt of a material manifesting a slight adhesion to the image material and, further, choosing a working temperature at which, on the one hand, the image material is softened to such an extent that it is deformed at a relatively low pressure and can be pressed into the paper but, on the other hand, retains a considerable cohesion so that image splitting is prevented. While a fully working condition can be thus obtained, it has been found that its stability, or reliability, is not sufficient for practical use of the technique. The reason appears to be that the interrelation of the adhesive and cohesive forces which occur is affected adversely by a slight change in the structure or condition of the belt surface, for instance, such as that caused by aging or wear, or by a slight change in the working temperaure, for instance, such as that caused by an increase of the ambient temperature.

It is known (see German Offenlegungsschrift No. 2,049,293) that the process can be improved by moistening the pressure belt with a separation agent, such as silicone oil. By applying a layer of oil, the adhesion of the image material to the surface of the pressure (or transfer) belt decreases to such an extent that the strength of this adhesion is substantially less than that at the surface of the copy paper. In this way annoying sticking of the image material to the belt can be prevented. This method, however, is undesirable in practice, in that the liquid supplied must always be applied in precise amount, for which purpose extra provisions are necessary, and there is considerable risk of contamination of the apparatus by spilling and the like while supplying or replenishing the liquid. Moreover, a portion of the oil applied is unavoidably transferred to the copy paper, often causing the paper to become liquid repellent so that it is hardly possible to write with conventional ink on the prepared copy.

It is also known (see German Offenlegungsschrift No. 2,460,696) that the process can be improved by keeping the paper and belt in contact with each other for an extended period of time after they have left the pressure zone. During this period, the combination of paper and belt is cooled down considerably, as a result of which the image material returns again wholly or partially to its original, glassy condition. The adhesion between the paer and the image material partially pressed into it, and the cohesion of the image material are then high and certainly surpass the adhesion occurring between the belt and image material. However, the cooling path required and the cooling means which may be installed along this path, make an apparatus for carrying out this process unattractively large and complicated.

The principal object of the present invention is to provide a process of the kind mentioned that, while using simple means, does not have the disadvantages of the known processes. This is achieved by performing a process as described in the first paragraph hereinabove in such a way that, at the place where belt and paper are separated, the relation between the thickness of the belt (D in *m*), and the speed of movement of the belt [V in *m*/second (*s*)] and the bending radius of the belt [R in meters (*m*)] is represented by the formula $(D \times V/R) \geqq 0.05$.

In this way, a process is obtained which, contrary to the known processes, is insensitive to temperature changes over a large range thereof in the pressure zone and/or to changes in the structure or condition of the belt surface. A possible explanation of this desirable result is that, in operation in accordance with the invention, the belt is bent relatively sharply so that a difference in speed between belt and paper is produced, as a result of which the image material is subjected to displacing forces which are so great that they far exceed the adhesion between belt and image material, and these forces are built up in so short a time that the viscosity of the image material does not change sufficiently for image splitting to occur.

The energy required for heating the image material in the process according to the invention can be supplied in various ways which are commonly known. For instance, the paper can be heated before it enters the pressure zone so that its heat content will be sufficient for softening the image material. This, however, involves a complication in that adjustment of the extent of heating must be made for each kind of copy paper used.

In an advantageous embodiment of the process according to the invention, whereby papers of various kinds and thicknesses can be processed without necessitating modifications in the operating conditions, the heating energy for the image material is obtained from the belt, for which prupose the belt is maintained continuously at a temperature between 120°–170° C, and the time of contact between the paper and the heated belt, i.e., the interval between the moment when any portion of the paper surface enters the pressure zone and the moment when the same surface portion is separated from the belt, is limited to not more than 0.1 second.

Figure 2:
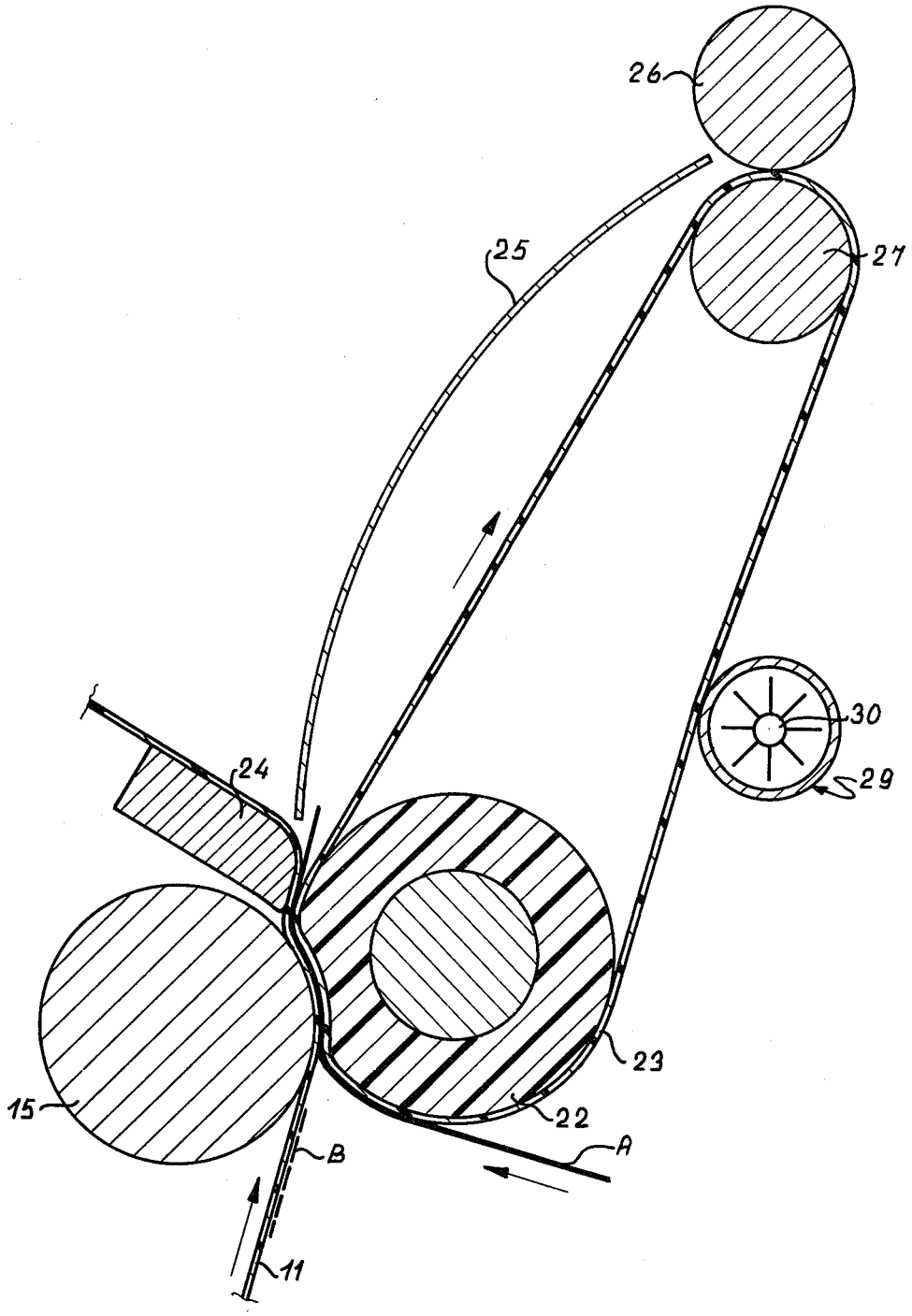

The invention will be further understood from the following description and the accompanying drawing of an illustrative embodiment thereof. In the drawing:

FIG. 1 is a schematic cross sectional view of a copying apparatus embodying the invention; and FIG. 2 is a schematic sectional view on an enlarged scale of the image fixing and separation station of the apparatus of FIG. 1.

As shown schematically in the drawings, an endless flexible photoconductive belt 1 is moved with a uniform speed over a number of guide rollers 2, in the direction indicated by an arrow. During this movement, an electrostatic charge is applied to the belt 1 from a corona device 3, and subsequently the belt is imagewise discharged by projecting onto it, by means of an objective or lens 5 and mirror 6, the light image of an original lying on a glass exposure plate 4, for which purpose the original is exposed with flash lamps (not shown) in a known manner.

The imagewise charge pattern formed by the exposure is subsequently developed and thereby converted into a powder image, by the action of a magnetic brush device 7 which, for instance, may be of the type described in U.S. Pat. No. 4,067,296. After this development, belt 1 passes over a drive roller 8 in engagement with a pressur roller 9, and thence over a roller 10 which can be moved up and down in a manner (not shown) to bring the belt 1 into (or out of) pressing contact with a pressure belt 11. In the embodiment illustrated, the pressure belt 11 serves as an intermediate or transfer belt onto which, but such contact, the powder image present on belt 1 is transferred in the manner described in U.S. Pat. No. 4,068,937.

After passing through the transfer zone at roller 10 the photoconductive belt 1 is driven into a slack lead thereof which extends onto a stationary curved surface 12 with the aid of which the belt is aligned in the manner described in U.S. Pat. No. 3,846,021. Finally, belt 1 passes a cleaning device 13 with the aid of which any remnants of powder images left on this belt are removed before belt 1 enters into a new cycle of imaging operations.

The pressure belt 11 is driven by a roller 14 with a uniform speed along a path which leads over guide rollers 15 and 16 and over an alignment device 17. Device 17 may be of the type described in U.S. Pat. No. 3,846,021. The belt 11 also runs over, and it is heated by a heating device 18 which in the present embodiment, for instance, comprises a curved metal plate having electrical heating elements incorporated in it.

A detector (not shown) senses the temperature of the belt and thereby controls the energy supply to the heater 18 in such manner that the belt temperature is held continuously within a certain range which lies between 120° and 170° C. though is dependent, as to the extent and temperature level of the range, on the composition of the image powder being used. Thus, for instance, the temperature should be in the range from 125° C. to 160° C. when an image material as described in Example 1 of Dutch patent application 72.03523 is used, while the temperature may be in the range from 130° C to 150° C. when the image material is a toner powder based on epoxy resin, of the type described in Example 3 of U.S. patent application Ser. No. 780,431 filed Mar. 23, 1977 as a continuation-in-part of application Ser. No. 701,211 filed June 30, 1976, now abandoned.

Other heating means can, of course, also be used instead of, or in addition to the heating device 18. For instance, the rollers 15 and 16 can be hollow rollers having internal heating elements.

In order to restrict loss of energy and irregular cooling of the belt 11 to a minimum, it is further advisable to insulate the space in which the belt 11 moves from its surroundings as much as practicable. For example, this space may be largely enclosed by walls 19 made of any suitable heating insulating material.

The image transferred from belt 1 to belt 11 adopts in a very short time the same temperature as the belt 11. As previously indicated, this temperature is chosen so that the image material is softened considerably by the heat conducted to it from the belt.

After passing through the heating zone along device 18, the portion of belt 11 carrying the image material enters and passes through a pressure zone which is formed by the nip between, on the one hand, roller 15 and belt 11 and, on the other hand, an elastic transfer roller 22 and a transfer belt 23 trained about roller 22. Meanwhile, a sheet of paper A is supplied into the nip (see particularly FIG. 2) from a sheet tray 20 via a guide 21 composed of plates and rollers. Thus, the sheet A is brought into contact in the nip with belt 11 and the image B of image material present on this belt, and under the pressure applied in the nip the elements of the image B are compressed and thereby forced into the surface of the sheet A.

At a location just beyond the roller 15, the belt 11 is guided over a stationary rod or bar 24 which has a rounded edge portion leading this belt into a path directed away from the transfer belt 23. At the location of this rounded edge portion, the belt 11 is turned abruptly away from the sheet of paper A.

The rounding-off of guide element 24, with consequent turning of the belt 11 through a sharp curvature directed away from the copy sheet, is such that the relation between the radius (R in *m*) of the belt curvature, the thickness (D in *m*) of the belt and the belt speed (V in *m/s*) is, as described hereinabove, defined by the equation (D 33 V/R) $\geqq$ 0.05. Thus, for example, in an apparatus as shown in FIG. 2, excellent results are obtained when the belt 11, being composed of an endless polyester web having a thickness of 0.5 mm and in turn, coated with a layer 0.5 mm thick of silicone rubber (for instance type 2CN of Emerson and Cuming), is driven with a speed of 0.26 m/s over a rounded edge portion of an element 24 having a radius of curvature of 5 mm.

When the speed of transport of the belt 11 of 1 mm. thickness is lower, for instance 0.15 m/s, substantially the same results are achieved if the radius of curvature is 3 mm. Excellent results are also obtained when the speed of transport is higher, for instance 0.3 m/s, or when the belt is thicker, for instance 2 mm thick, if the radius of curvature is 7 mm.

In the illustrative embodiment of FIG. 2, the roller 22 is covered with a compressible elastic layer, for instance, one composed of rubber of 60 durometers (Shore A) hardness, and the transport belt 23 is made of silicone rubber. The pressure with which the image material is pressed into the paper can be adjusted readily by increasing or decreasing the force with which roller 22 is pressed toward roller 15. The zone over which the sheet of paper A and the image bearing belt 11 make contact with each other is of course dependent not only on this pressure but also and particularly on the location of the element 24 and the location and diameter of the rollers 15 and 22. When these parameters are so adjusted that the pressure zone has a length of 2 to 2.5 cm and the speed of the belt 11 therethrough is, for instance, 0.26 m/s as mentioned above, the residence time per surface portion of sheet A in the pressure zone is less than 0.1 second, and it results that the operation of the process and apparatus, for practical purposes, has become independent of the kind of paper used for the sheet A. In operations of the apparatus described, papers of different kinds and compositions and having weights varying between 40 and 120 g/m$^2$ can be utilized arbitrarily without necessitating any adaptation of the apparatus.

As already indicated herein, the softened thermoplastic material forming the powder image is pressed into the sheet of paper in the pressure zone, so that it sticks (adheres) permanently to the paper, and is thus fixed thereto. Upon leaving the pressure zone, the sheet A follows a path bounded by the transport belt 23 and a guide plate 25, and is finally discharged into a copy tray 28 be being passed between rollers 26 and 27.

The transport belt 23 could become contaminated of image material were to come into contact with this belt during the transfer. Such contamination can be prevented in a simple manner that is known per se, i.e., by letting a metal roller 29 heated to about 100° C., for instance by an element 20 inside this roller, rotate in contact with the surface of belt 23.

In the embodiment of the invention, described above, the process is carried out in an apparatus in which the image material is transferred from a belt onto the copy paper. It will be evident, however, that the image material may be present on either the belt or the paper as it enters into the pressure zone; so the process can also be carried out with apparatus of the type described in the above mentioned German Offenlegungsschrift No. 2,049,293. Moreover, in accordance with the invention, an image present on the belt can be combined with an image present on the paper.

What is claimed is:

1. In a process for fixing onto paper images formed of thermoplastic material, wherein the material of such an image in thermally softened condition is transported through a pressure zone while being pressed between and in contact with the paper and a belt moving together through said zone, and upon leaving said zone the paper and belt are separated from each other by forced movement of the belt along a path turning away from the paper, the improvement which comprises maintaining the thickness of said belt, the speed of movement of said belt and the radius of curvature of said path in a relationship represented by the formula $(D \times V/R) \geqq 0.05$, in which D is said thickness (in meters), V is said speed (in meters per second) and R is said radius (in meters).

2. A process according to claim 1, further comprising maintaining said belt in a temperature range between 120° and 170° C. suited for softening the image material, heating said image material to said softened condition by contact thereof with said belt and limiting the time of contact between the paper and said belt to not more than 0.1 second.

3. In a process according to claim 1, moving said belt continuously to and through said pressure zone at a constant speed, keeping said belt heated to a temperature suited for softening said image material, transporting said image to said pressure zone on a portion of the surface of said belt, pressing a sheet of paper against and moving it with said belt surface portion in and through said zone, and immediately beyond said zone guiding said belt away from said sheet by sliding the belt over a rounded surface having a radius of curvature according to said formula.

4. A process according to claim 3, said radius of curvature being of between 1 and 10 mm.

5. A process according to claim 3, said temperature being in a rage between 120° and 170° C., said speed being such that the time of contact between said belt and a surface portion of said sheet pressed against the belt does not exceed 0.1 second, and said radius of curvature being of between 1 and 10 mm.

6. In an apparatus for fixing onto paper images formed of thermoplastic material, including an endless belt having a surface for transporting the material of such an image, means for driving said belt continuously, means for pressing paper against and moving it with said belt surface in a pressure zone and thereby transporting the image material through said zone while pressing said material between and in contact with the paper and belt, and means beyond said zone for guiding the belt along a path turning away from the paper, the improvement which comprises said guiding means having a radius of curvature (R, in meters) in a relationship to the thickness of said belt (D, in meters) and the speed of movement of said belt by said driving means (V, in meters per second) as represented by the formula $(D \times V/R) \geqq 0.05$.

7. Apparatus according to claim 6, said guiding means comprising a bar positioned immediately beyond said zone and having a rounded surface portion over which said belt slides along said path, the radius of curvature of said rounded surface portion being between 1 and 10 mm.

8. Apparatus according to claim 6, further comprising means for heating said belt surface so as to keep it in a temperature range between 120° and 170° C. suited for softening said image material, said driving means being operative to move said belt at a speed such that the time of contact between said belt and a surface portion of paper pressed against said belt does not exceed 0.1 second.

9. Apparatus according to claim 6, said driving means being operative to move said belt at a speed of from about 0.15 mm. to about 0.3 m. per second.

10. Apparatus according to claim 6, said belt thickness being of about 1 to about 2 mm.

11. Apparatus according to claim 6, wherein D has a value of about 0.001 m., V has a value of about 0.26 *m/s* and R has a value of about 0.005 m.

12. Apparatus according to claim 6, wherein D has a value of about 0.001 m., V has a value of about 0.15 m/s and R has a value of about 0.003 m.

13. Apparatus according to claim 6, wherein D has a value of about 0.001 m., V has a value of about 0.3 *m/s* and R has a value of about 0.003 m.

14. Appartus according to claim 6, wherein D has a value of about 0.002 m., V has a value of about 0.15 *m/s* and R has a value of about 0.007 m.

* * * * *

UNITED STATES PATENT OFFICE

CERTIFICATE OF CORRECTION

Patent No. 4,095,886 Dated June 20, 1978

Inventor(s) Gerardus A. J. Koeleman et al

It is certified that error appears in the above-identified patent and that said Letters Patent are hereby corrected as shown below:

Column 2, line 16: in place of "paer" read -- paper --.

Column 3, line 26: in place of "pressur" read -- pressure --.

Column 3, line 32: in place of "but" read -- by --.

Column 4, line 42: in place of "D33V/R" read -- DxV/R --.

Column 5, line 21: in place of "be" read -- by --.

Column 5, line 22: in place of "of" read -- if --.

Column 6, line 12: in place of "rage" read -- range --.

Signed and Sealed this

*Sixth* Day of *February 1979*

[SEAL]

*Attest:*

RUTH C. MASON
*Attesting Officer*

DONALD W. BANNER
*Commissioner of Patents and Trademarks*